US009487895B2

(12) United States Patent
Han

(10) Patent No.: US 9,487,895 B2
(45) Date of Patent: Nov. 8, 2016

(54) PORTABLE MULTI-SEWING MACHINE

(71) Applicant: Tea-hee Han, Seoul (KR)

(72) Inventor: Tea-hee Han, Seoul (KR)

( * ) Notice: Subject to any disclaimer, the term of this patent is extended or adjusted under 35 U.S.C. 154(b) by 0 days.

(21) Appl. No.: 14/760,483

(22) PCT Filed: Jan. 21, 2014

(86) PCT No.: PCT/KR2014/000589

§ 371 (c)(1),
(2) Date: Jul. 13, 2015

(87) PCT Pub. No.: WO2014/112849

PCT Pub. Date: Jul. 24, 2014

(65) Prior Publication Data

US 2015/0354117 A1 Dec. 10, 2015

(30) Foreign Application Priority Data

Jan. 18, 2013 (KR) ..... 10-2013-0005693

(51) Int. Cl.

| | |
|---|---|
| ***D05B 73/00*** | (2006.01) |
| ***D05B 43/00*** | (2006.01) |
| ***D05B 49/00*** | (2006.01) |
| ***D05B 57/00*** | (2006.01) |
| ***D05B 69/30*** | (2006.01) |
| ***D05B 1/00*** | (2006.01) |

(52) U.S. Cl.

CPC ..... *D05B 73/00* (2013.01); *D05B 1/00* (2013.01); *D05B 43/00* (2013.01); *D05B 49/00* (2013.01); *D05B 57/00* (2013.01); *D05B 69/30* (2013.01)

(58) Field of Classification Search

CPC ..... D05B 19/00; D05B 47/00–47/04; D05B 73/00–73/06; D05B 43/00; D05B 49/00; D05B 57/00; D05B 57/28; D05B 69/30; D05B 1/00

See application file for complete search history.

(56) References Cited

U.S. PATENT DOCUMENTS

| | | | | |
|---|---|---|---|---|
| 2,390,571 A * | 12/1945 | Colegrove | D05B 43/00 | 112/258 |
| 2,639,683 A * | 5/1953 | Huntington | D05B 81/00 | 112/169 |
| 2,778,328 A * | 1/1957 | Doyen | B65B 51/07 | 112/11 |
| 2,848,963 A * | 8/1958 | Johnson | D05B 19/00 | 112/444 |

(Continued)

FOREIGN PATENT DOCUMENTS

| | | |
|---|---|---|
| JP | 58-067283 A | 4/1983 |
| JP | 61-006382 U | 1/1986 |
| JP | 61-054768 U | 4/1986 |

OTHER PUBLICATIONS

International Search Report for PCT/KR2014/000589 mailed May 29, 2014 from Korean Intellectual Property Office.

*Primary Examiner* — Ismael Izaguirre
(74) *Attorney, Agent, or Firm* — KORUS Patent, LLC; Seong Il Jeong

(57) ABSTRACT

Provided is a portable sewing machine. The portable sewing machine has an upper thread part and a lower thread part inside of the sewing machine and an interior structure simplified by defining the inside space of the sewing machine into a sewing needle part, a lever part, a motor part, a power supply part and a pulley part so as to reduce parts, size or weight. The portable sewing machine can be convenient to carry around and to be used without any limitation of places, and adsorption plates (see explanation of terms) are provided to the bottom surface of the sewing machine such that sewing work can be performed at any place where the sewing machine can be attached by means of the adsorption plates.

3 Claims, 6 Drawing Sheets

Portable multi-sewing machine motor control part

(56) References Cited

U.S. PATENT DOCUMENTS 3,034,459 A * 5/1962 Shelley ..... B65B 51/07
112/10
3,168,849 A * 2/1965 Zilg ..... B26D 5/16
112/169
3,420,198 A * 1/1969 Greulich ..... D05B 73/00
112/238
5,669,318 A * 9/1997 Tsay ..... D05B 1/12
112/169
6,883,447 B1 * 4/2005 Kitazawa ..... D05B 43/00
112/302

* cited by examiner

Portable multi-sewing machine motor control part

PORTABLE MULTI-SEWING MACHINE

CROSS REFERENCE TO PRIOR APPLICATIONS

This application is a National Stage Application of PCT International Patent Application No. PCT/KR2014/000589 filed on Jan. 21, 2014, under 35 U.S.C. §371, which claims priority to Korean Patent Application No. 10-2013-0005693 filed on Jan. 18, 2013, which are all hereby incorporated by reference in their entirety.

TECHNICAL FIELD

The present invention relates to a portable multi-sewing machine, which is convenient to carry around and use and capable of sewing clothing when the clothing that a user is wearing is embarrassedly damaged at home, at work or during outdoor activities, when the user wants to rapidly make clothing with various fabrics and the like anywhere without any limitations of places, or when the user wants to make various kinds of clothing at home.

BACKGROUND ART

In general, a sewing machine has configuration, in which a rotating wheel is rotated by a hand or a foot or electric force so as to move a thread take up lever, a needle bar, a feed dog and a shuttle race, thereby enabling sewing. Such a sewing machine includes a sewing machine part for performing sewing work by the features and functions of an upper thread adjuster, a thread take up lever, a presser foot, a pressure adjuster, a feed dog, a shuttle race, a feed dog adjuster, a reverse movement adjuster, a lower thread adjuster, a lower thread adjustment screw, a bobbin winder and the like, a sewing machine table, an external thread support and the like. Therefore, the sewing machine has a disadvantage in use since the sewing machine in the above configuration is inconvenient to carry around. Further, the above sewing machine has a limitation in use since the sewing machine has to be placed on a sewing machine table in order to perform sewing work. Therefore, the sewing machine cannot be used for immediately sewing clothing when the clothing is damaged during outdoor activities. Further, even when using the sewing machine at home, the sewing machine cannot be conveniently moved from a room to another room for as desired by the user.

DISCLOSURE

Technical Problem

Accordingly, the present invention has been made in an effort to solve the above-mentioned problems occurring in the prior arts, and it is an objective of the present invention to provide a sewing machine convenient to carry around so as to enable the convenient use of the sewing machine anywhere without any limitations of places.

Technical Solution

To achieve the above objectives, the present invention provides a portable multi-sewing machine, which can integrate a needle part, a lever part, a motor part, a pulley adjuster part, a pulley part, an upper thread part, a lower thread part, a rail part and the like to the inside of a sewing machine main body so as to enable the single sewing machine to be carried around conveniently, and is provided with adsorption plates (see explanation of terms) on the bottom surface of the sewing machine so as to enable sewing work to be carried out by the sewing machine by fixing the sewing machine at any place where the adsorption plates can be attached.

ADVANTAGEOUS EFFECTS

According to the portable multi-sewing machine having the above features, a user of the portable multi-sewing machine can freely carry and conveniently use the portable multi-sewing machine at any indoor or outdoor working places when making or repairing clothing and the like since the portable multi-sewing machine has no limitations of places even omitting a sewing machine table.

EXPLANATION OF TERMS 1. assembly type: attachable and detachable assembly type
2. upper thread bobbin: bobbin for a thread used as an upper thread
3. lower thread bobbin: bobbin for a thread used as a lower thread
4. adsorption plates: adsorption plates for enabling a portable multi-sewing machine of the present invention to be fixed for sewing and the like to a table or an attachment base and the like of the present invention when carrying the portable multi-sewing machine of the present invention and a portable bobbin base.

MODE FOR INVENTION

Figure 1:
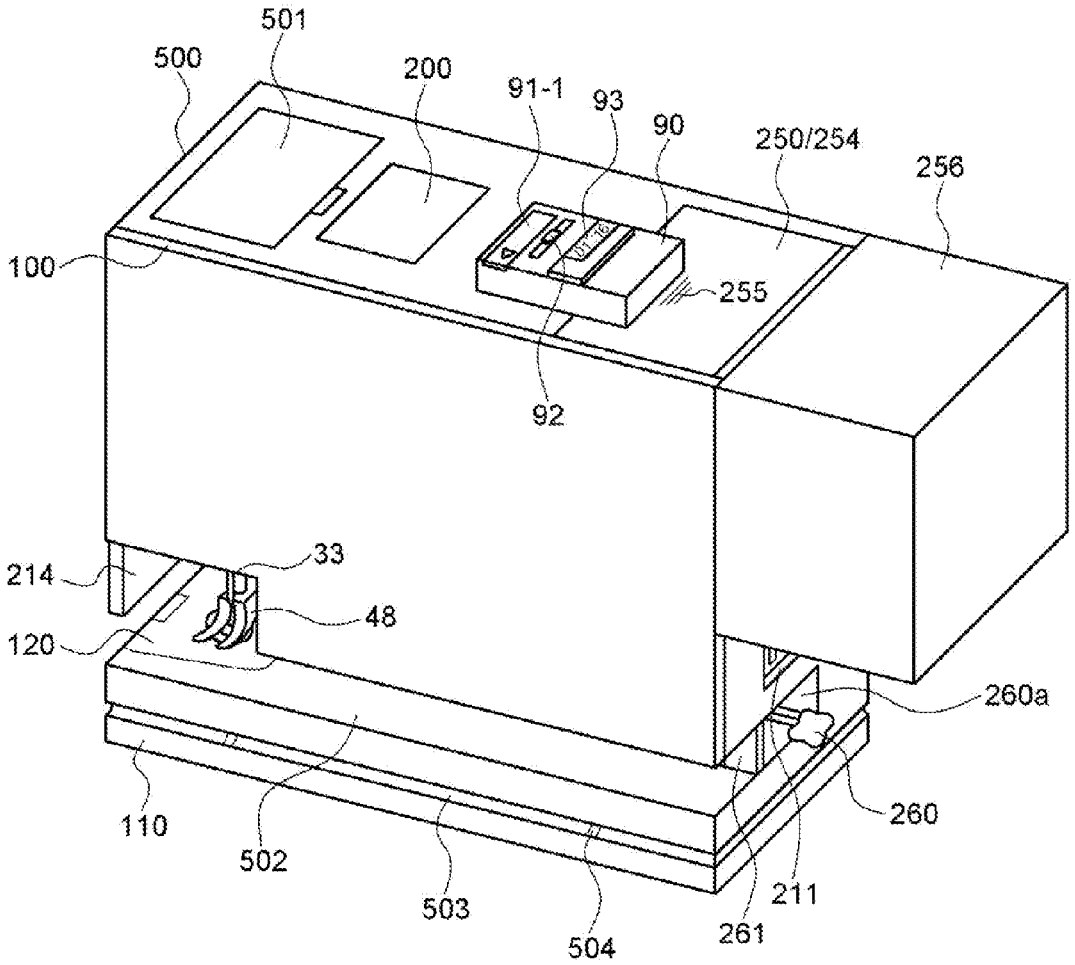
FIG. 1 is a left side view showing a portable multi-sewing machine according to a first embodiment of the present invention.
Figure 2:
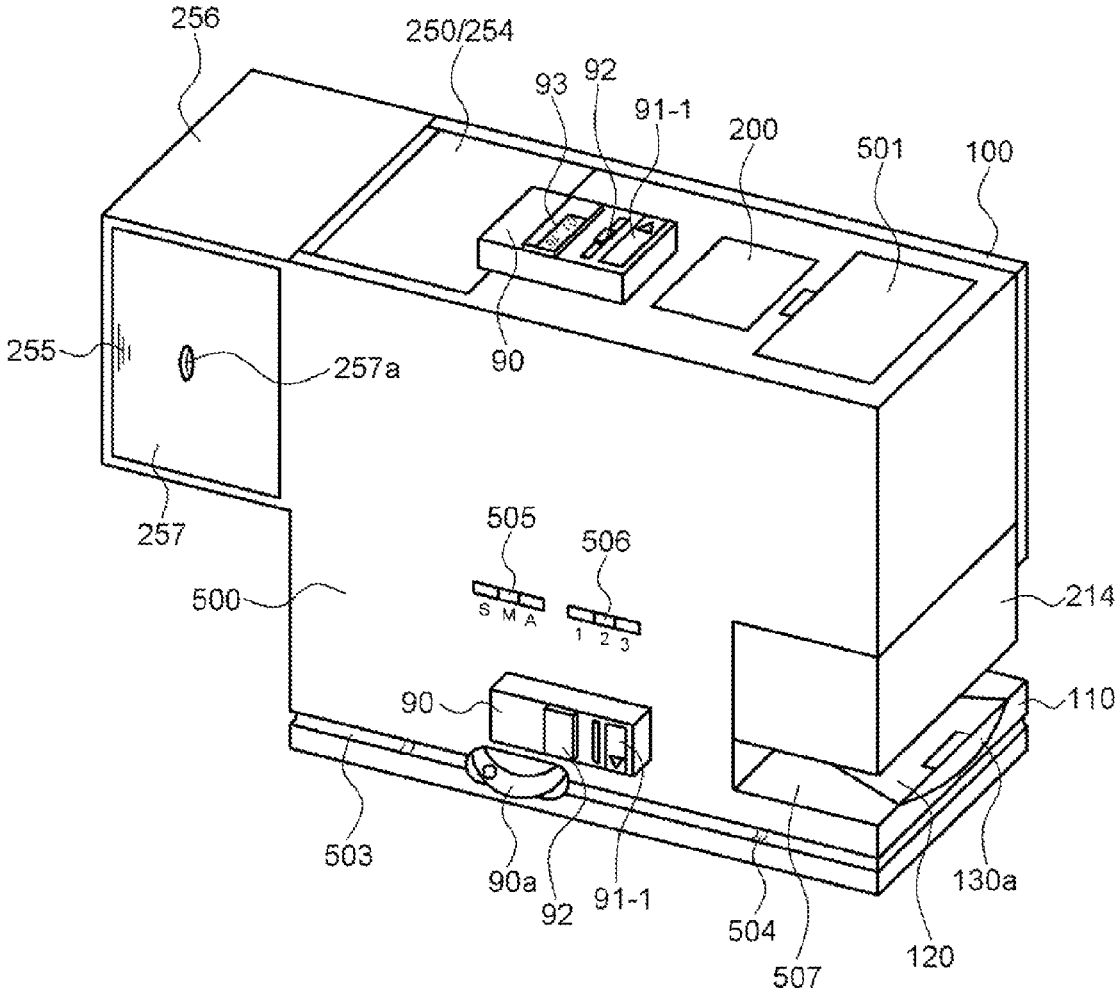
FIG. 2 is a right side view showing the portable multi-sewing machine according to the first embodiment of the present invention.
Figure 3:
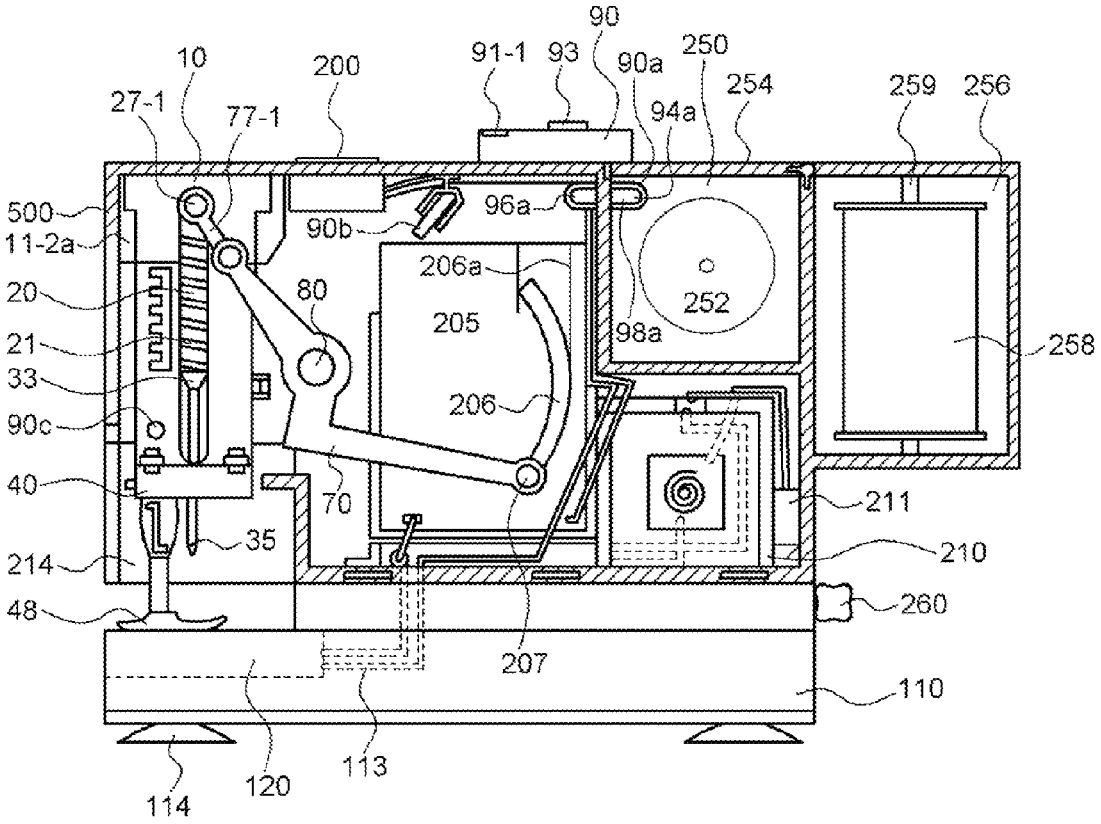
FIG. 3 is a cross-sectional view showing the left part of the portable multi-sewing machine according to the first embodiment of the present invention.
Figure 4:
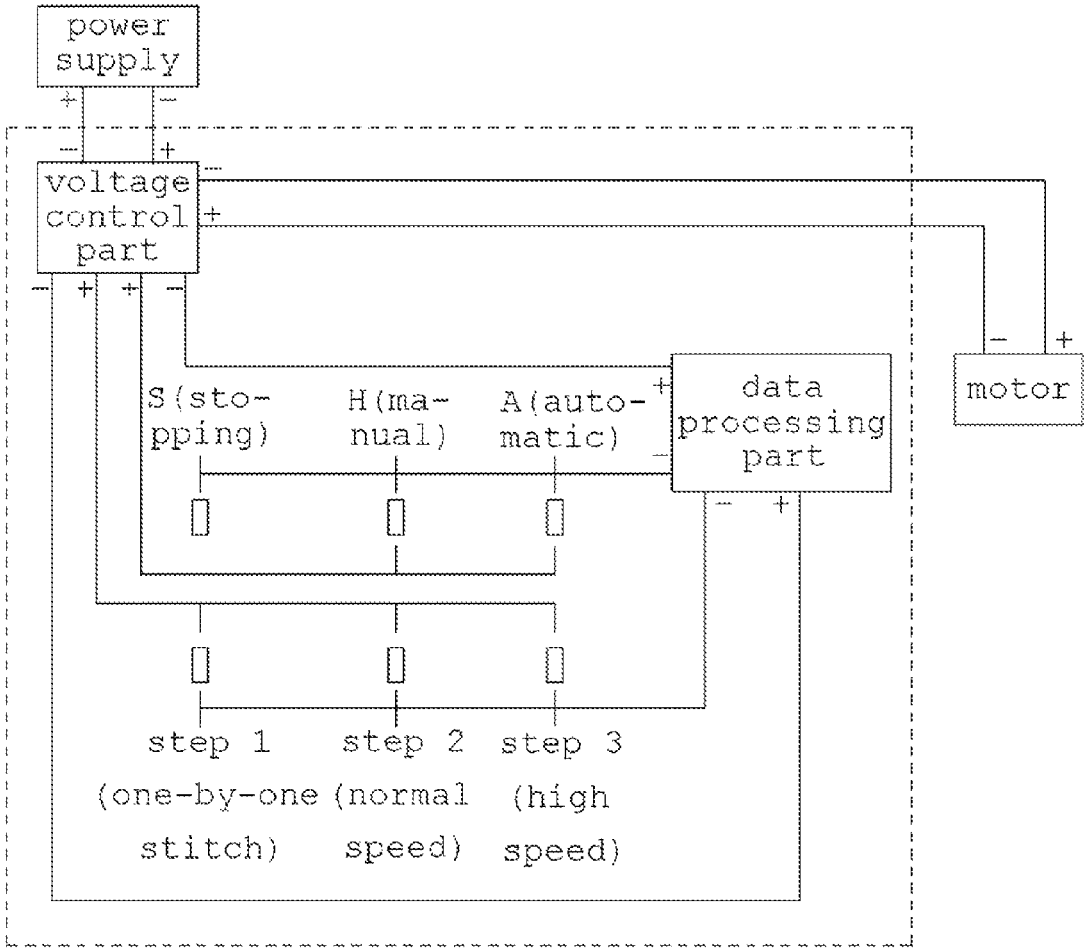
FIG. 4 is a block diagram showing the control unit of the portable multi-sewing machine according to the present invention.
Figure 5:
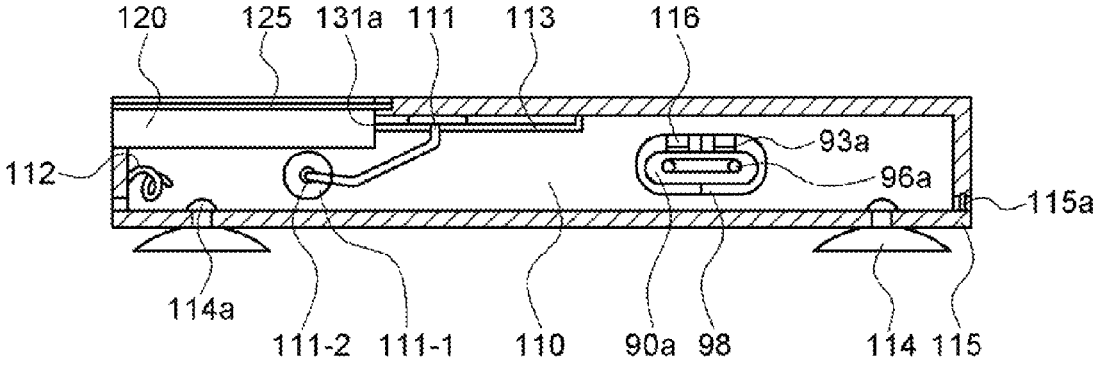
FIG. 5 is a left side cross-sectional view showing a lower thread part according to the first embodiment of the present invention.

The best mode of a sewing machine is provided in a structure, in which a needle part, a lever part, a motor part, a pulley adjuster part, a pulley part, an upper thread part, a lower thread part, a rail part and the like are arranged together in the main body of the sewing machine so as to be integrated therein such that the single sewing machine is simply carried to conveniently perform sewing work at any time at any place.

Hereinafter, with reference to the attached drawings, a portable multi-sewing machine according to preferred embodiments of the present invention will be described in detail. FIG. 1 to FIG. 4 show a portable multi-sewing machine provided with functions convenient to carry and use according to a first embodiment of the present invention, wherein the portable multi-sewing machine of the present invention includes a portable multi-sewing machine main body 500 and constituent elements such as a needle part, a lever part, a motor part, a pulley adjuster part, a pulley part, an upper thread part, a lower thread part, a rail part and the like, which are provided to the inside of the portable multi-sewing machine main body 500 so as to be integrated therein. Now, referring to FIG. 1 to FIG. 4, in the portable multi-sewing machine, the needle part has configuration, in which a needle booth 10 can be attached to or detached from the portable multi-sewing machine main body 500 by an assembly type needle booth attachable and detachable part 11-2*a*, a sewing needle fixing case 20, which incorporates a spring 21 and a connection shaft 27-1, can be inserted into or withdrawn from the sewing needle fixing case 20, and the sewing needle fixing case 20 fixes a sewing needle 33 in the center thereof and operates the spring 21 in the vertical direction by the operation of the connection shaft 27-1 so as to enable sewing work.

An attachable and detachable presser foot part 40 having a foot part 48 for pressing clothing at the time sewing can be attached to or detached from the assembly type needle booth 10. Therefore, any other sewing needle part for a flat needle, a button needle and any other sewing needle can be attachably or detachably provided to the assembly type needle booth 10

Further, the lever part of the portable multi-sewing machine can be located to a central fixing shaft 80 so as to be attached thereto or detached therefrom. When one side of a lever 70 of the lever part, which is connected to an arc shaft 207, operates at an arc operation part 206, an arc interval 206*a* in the operation of the one side of the lever is reflected to an arc in the operation of a connection hand 77-1 at the other side of the lever. Therefore, the lever has a structure, in which the center portion of the lever is bent around the center fixing shaft 80 at an angle for reflecting the intervals of the both sides of the lever, thereby increasing space efficiency. Therefore, the arc shaft 207 is connected to the connection shaft 27-1 of the sewing needle fixing case 20 by the operation of the bent lever 70 and operates by a portable multi-sewing machine motor 205, thereby enabling sewing work.

In addition, the motor part of the portable multi-sewing machine has a structure, in which a portable multi-sewing machine motor control part controls the portable multi-sewing machine motor 205 by the adjustment of a motor function adjuster 505 and a motor step adjuster 506, which can select the function and performance of the portable multi-sewing machine motor 205, and an operation button 200 is supplied with power from a battery case 210 or a socket part 211 and operates the portable multi-sewing machine motor 205, such that the arc shaft 207 operates through the arc operation part 206 together with the bent lever 70 and the connection shaft 27-1, which is connected to the connection hand 77-1, thereby enabling sewing work.

Further, the pulley adjuster part of the portable multi-sewing machine includes a sliding cover 91-1 to be opened or closed for inserting a battery for a pulley adjuster 90, a pulley adjuster 92 for selecting the operation mode of a pulley 90*a* so as to control the pulley 90*a* in any one of backward (B), forward (F), stopping (S) and automatic (A) modes, a remaining power & time display 93, a pulley main body 90*a*, and a pulley adjustment gear shaft 98, which is connected to the pulley main body 90*a* and can control the feeding direction or speed, tension and the like of an upper thread or a lower thread at the time of sewing work.

Furthermore, the pulley part of the portable multi-sewing machine includes a thread inlet 94*a*,a thread outlet 96*a*, an inner pulley 98*a* and a rotation stopper 93*a*, which are integrally provided to the pulley main body 90*a*. The movements of the thread inlet 94*a* and the thread outlet 96*a* of the pulley main body 90*a* are limited to predetermined degrees by the rotation stopper 93*a* or a pulley rotation prevention film 116 when the pulley main body 90*a* rotates in the feeding of the upper thread or the lower thread during the sewing. Meanwhile, the inner pulley 98*a* rotates in the rotation direction of the pulley adjustment gear shaft 98 so as to make the feeding of the upper thread or the lower thread smooth.

The upper thread part of the portable multi-sewing machine includes upper thread bobbin compartment 250 serving as a space for receiving an upper thread bobbin 252 and an upper thread bobbin compartment cover 254 provided with a cover-opening display 255 for enabling the insertion of the upper thread bobbin 252. The upper thread has a path from the upper thread bobbin compartment 250 to a sewing needle-eye 35 through the pulley main body 90*a* used as an upper thread pulley, the thread inlet 94*a*, the thread outlet 96*a*, a thread guider pulley 90*b* and a thread holder 90*c*, wherein the upper thread is inserted into the sewing needle-eye 35 so as to carry out sewing work.

Further, the lower thread part of the portable multi-sewing machine includes a lower thread bobbin compartment cover 257 provided with a cover-opening display 255 for enabling the insertion of a lower thread bobbin 258, and a lower thread bobbin compartment 256 having a lower thread bobbin holding column 259 to hold the lower thread bobbin 258. The lower thread has a path from the lower thread outlet 257*a* of the lower thread bobbin compartment 256 to the thread holder 90*c* provided in the lower thread part 110 through the pulley main body 90*a* used as a lower thread pulley, the thread inlet 94*a*, the thread outlet 96*a*, the thread guider pulley 90*b* in the lower thread part 110 and an attachable and detachable lower thread operation part 120, wherein the lower thread is used together with the upper thread during sewing work.

The attachable and detachable lower thread operation part 120, which can be attached to or detached from the lower thread part 110, is supplied with power from the battery case 210 through a lower thread part outer line 113 so as to control the lower thread. Further, the attachable and detachable lower thread operation part 120 can serve to control the interval of the lower thread and the back and forth and right and left movement of the lower thread during sewing work, by adjusting the interval of the lower thread by a lower thread adjuster 130*a* before the sewing work.

In addition, four adsorption plates 114 are provided to the bottom surface of the portable multi-sewing machine main body 500, that is, the outer bottom of the lower thread part 110, such that the portable multi-sewing machine can be attached to any appropriate object. Therefore, the portable multi-sewing machine can be freely carried and the sewing work can be performed at any place, where the adsorption plates 114 can be attached.

Figure 6:
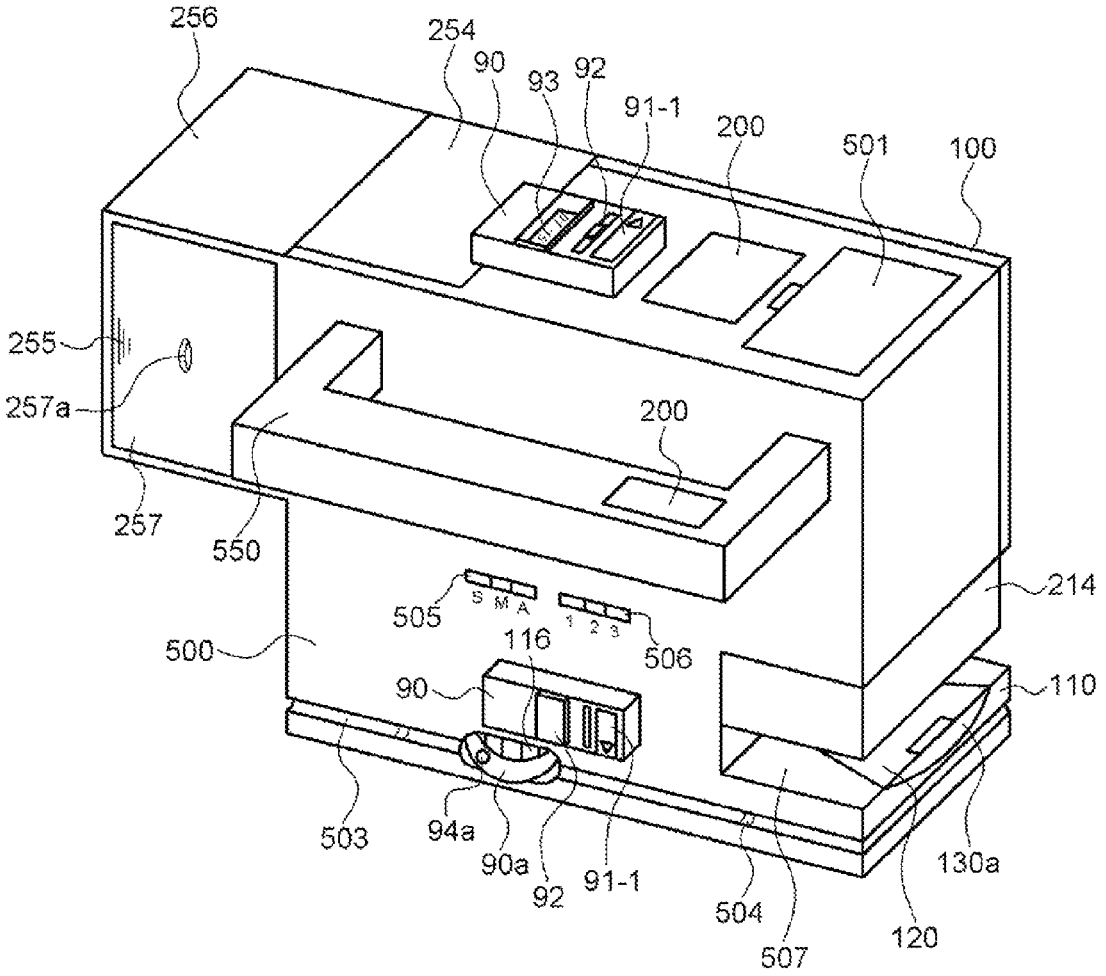
FIG. 6 is a right side view showing a portable multi-sewing machine according to a second embodiment of the present invention.

FIG. 6 shows a second embodiment of the present invention. Referring to FIG. 6, the portable multi-sewing machine main body 500 is further provided with a portable multi-sewing machine handle 550 on the right side surface thereof and the position of the operation button 200 is moved to the front side of the handle, so as to improve the carrying and convenient use of the portable multi-sewing machine.

Therefore, a user simply carries a single portable multi-sewing machine according to the first embodiment and the second embodiment and can conveniently perform sewing work in various patterns without any difficulties at any time and at any place.

The present invention can be used in the industry field of manufacturing portable multi-sewing machines since the single sewing machine which is integrated can be carried so as to conveniently perform sewing work in various patterns without any difficulties at any places.

The invention claimed is:

1. A portable sewing machine convenient to carry by integrating constituent elements, which includes a needle part, a lever part, a motor part, a pulley adjuster part, a pulley part, an upper thread part, a lower thread part arranged in a portable sewing machine main body, characterized in that:

the needle part is arranged in the front region of the main body and the motor part is arranged behind the needle part such that the needle part and the motor part are connected by the lever part and a motor is driven under the power supply control of a socket part or a battery case capable of containing a battery so as to operate the lever part and the needle part, and an upper thread bobbin compartment of the upper thread part and a lower thread bobbin compartment of the lower thread part are arranged in the upper end of the rear region of the main body such that an upper thread is fed to the needle part through the pulley part of the upper thread part and a lower thread is fed to an attachable and detachable lower thread operation part through the pulley part of the lower thread part at the lower end of the main body so as to carry out sewing and stitching up by the operation setting of the pulley adjuster part provided at the outside of the main body and the operations of the needle part.

2. The portable sewing machine of claim 1, further comprising adsorption plates provided to the bottom surface of the sewing machine, whereby sewing work can be carried out by fixing the sewing machine at any place where the adsorption plates can be attached.

3. The portable sewing machine of claim 1, wherein the attachable and detachable lower thread operation part is supplied with power from the battery case through a lower thread part outer line so as to control the lower thread.

* * * * *